US011795969B2

(12) United States Patent
Iwakiri

(10) Patent No.: US 11,795,969 B2
(45) Date of Patent: Oct. 24, 2023

(54) CENTRIFUGAL COMPRESSOR AND TURBOCHARGER

(71) Applicant: MITSUBISHI HEAVY INDUSTRIES ENGINE & TURBOCHARGER, LTD., Sagamihara (JP)

(72) Inventor: Kenichiro Iwakiri, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 90 days.

(21) Appl. No.: 17/606,250

(22) PCT Filed: May 30, 2019

(86) PCT No.: PCT/JP2019/021546
§ 371 (c)(1),
(2) Date: Oct. 25, 2021

(87) PCT Pub. No.: WO2020/240775
PCT Pub. Date: Dec. 3, 2020

(65) Prior Publication Data

US 2022/0205458 A1 Jun. 30, 2022

(51) Int. Cl.
*F04D 29/44* (2006.01)
*F01D 9/02* (2006.01)
*F04D 29/28* (2006.01)

(52) U.S. Cl.
CPC ..... *F04D 29/441* (2013.01); *F01D 9/026* (2013.01); *F04D 29/284* (2013.01);
(Continued)

(58) Field of Classification Search
CPC ..... F04D 29/284; F04D 29/441; F01D 9/026; F05D 2220/40; F05D 2250/52; F05D 2250/70
See application file for complete search history.

(56) References Cited

U.S. PATENT DOCUMENTS 9,366,265 B2 * 6/2016 Tomita ..... F04D 29/441
2010/0178183 A1 7/2010 Dettmann et al.
(Continued)

FOREIGN PATENT DOCUMENTS

CN 108700089 A 10/2018
DE 102013017694 A1 * 7/2014 ..... F04D 25/024
(Continued)

*Primary Examiner* — Audrey B. Walter
(74) *Attorney, Agent, or Firm* — Birch, Stewart, Kolasch & Birch, LLP

(57) ABSTRACT

In a centrifugal compressor, when the position of the tongue of the scroll section in the circumferential direction of the impeller is defined as 60° and the downstream direction in the rotation direction of the impeller is defined as the positive direction of the position in the circumferential direction, a diffuser section outer diameter distribution indicating a relationship between the position in the circumferential direction and outer diameter R of the diffuser section includes an outer diameter increasing portion where the outer diameter R increases going toward the positive direction, and in the diffuser section outer diameter distribution, the position of a start point of the outer diameter increasing portion is 150° or less, and the position of an end point of the outer diameter increasing portion is 270° or more.

9 Claims, 14 Drawing Sheets

(52) U.S. Cl.
CPC ..... *F05D 2220/40* (2013.01); *F05D 2240/14* (2013.01); *F05D 2250/52* (2013.01); *F05D 2250/70* (2013.01)

(56) References Cited

U.S. PATENT DOCUMENTS

| | | | | |
|---|---|---|---|---|
| 2013/0266432 | A1 * | 10/2013 | Iwakiri ..... | F04D 29/4206 415/204 |
| 2018/0347382 | A1 | 12/2018 | Iwakiri et al. | |
| 2021/0123456 | A1 | 4/2021 | Iwakiri | |

FOREIGN PATENT DOCUMENTS

| | | | | |
|---|---|---|---|---|
| DE | 112015002773 | T5 * | 3/2017 | ..... F01D 25/24 |
| JP | 3033902 | B1 | 4/2000 | |
| JP | 2010-529358 | A | 8/2010 | |
| WO | WO2017/109949 | A1 | 6/2017 | |
| WO | WO2019/087385 | A1 | 5/2019 | |

* cited by examiner

CENTRIFUGAL COMPRESSOR AND TURBOCHARGER

TECHNICAL FIELD

The present disclosure relates to a centrifugal compressor and a turbocharger.

BACKGROUND ART

A casing of a centrifugal compressor includes a scroll section forming a scroll passage on the outer peripheral side of an impeller, and a diffuser section forming a diffuser passage for supplying compressed air compressed by the impeller to the scroll passage.

Patent Document 1 discloses a configuration in which the outer radius of the diffuser section in a region at the beginning of the volute near the tongue of the scroll section is expanded more than in other regions in order to reduce pressure pulsation in the centrifugal compressor.

CITATION LIST

Patent Literature

Patent Document 1: JP2010-529358A

SUMMARY

Problems to be Solved

In the diffuser passage of a centrifugal compressor, as the annular passage area expands toward the outside in the radial direction of the impeller, the kinetic energy of air is converted into pressure energy, and the pressure is recovered. Therefore, in order to reduce the pressure drop in the scroll passage and the downstream outlet passage of the centrifugal compressor, it is desirable to recover the pressure as much as possible in the diffuser passage. To this end, it is effective to increase the outer radius of the diffuser section.

However, when the outer radius of the diffuser section in a region at the beginning of the volute near the tongue is expanded more than in other regions as described in Patent Document 1, the pressure drop increases in the scroll passage, which may cause a reduction in efficiency of the centrifugal compressor.

In view of the above, an object of at least one embodiment of the present invention is to provide a highly efficient centrifugal compressor.

Solution to the Problems (1) A centrifugal compressor according to at least one embodiment of the present invention comprises an impeller and a casing. The casing includes: a scroll section forming a scroll passage on an outer peripheral side of the impeller; and a diffuser section forming a diffuser passage for supplying compressed air compressed by the impeller to the scroll passage. When a position of a tongue of the scroll section in a circumferential direction of the impeller is defined as 60°, and a downstream direction in a rotation direction of the impeller is defined as a positive direction of a position in the circumferential direction, a diffuser section outer radius distribution indicating a relationship between the position in the circumferential direction and outer radius R of the diffuser section includes an outer radius increasing portion where the outer radius R increases going toward the positive direction, and in the diffuser section outer radius distribution, a position of a start point of the outer radius increasing portion is 150° or less, and a position of an end point of the outer radius increasing portion is 270° or more.

With the centrifugal compressor described in the above (1), the outer radius R of the diffuser section can be made smaller at the winding start (position at 150° or less) where the cross-sectional area of the scroll passage is relatively small and the increase in the outer radius R of the diffuser section has a large effect on the cross-sectional shape of the scroll passage, while the outer radius R of the diffuser section can be made larger at the winding end (position at 270° or more) where the cross-sectional area of the scroll passage is relatively large and the increase in the outer radius R of the diffuser section has a relatively small effect on the cross-sectional shape of the scroll passage. Accordingly, the efficiency improving effect of extending the outer radius R of the diffuser section (the efficiency improving effect of pressure recovery in the diffuser passage) can be effectively achieved, and a highly efficient centrifugal compressor can be obtained.

(2) In some embodiments, in the centrifugal compressor described in the above (1), in the diffuser section outer radius distribution, $A2-A1 \geq 150°$ is satisfied, where A1 is the position of the start point of the outer radius increasing portion, and A2 is the position of the end point of the outer radius increasing portion.

With the centrifugal compressor described in the above (2), it is possible to more effectively achieve the efficiency improving effect described in the above (1).

(3) In some embodiments, in the centrifugal compressor described in the above (2), $A2-A1 \geq 180°$ is satisfied.

With the centrifugal compressor described in the above (3), it is possible to more effectively achieve the efficiency improving effect described in the above (1).

(4) In some embodiments, in the centrifugal compressor described in any one of the above (1) to (3), the outer radius increasing portion includes a nonlinear increasing portion where the outer radius R nonlinearly increases going toward the positive direction.

With the centrifugal compressor described in the above (4), by appropriately setting the shape of the nonlinear increasing portion, it is possible to more effectively achieve the efficiency improving effect described in the above (1).

(5) In some embodiments, in the centrifugal compressor described in the above (4), a portion of the nonlinear increasing portion belonging to a range from 210° position to 360° position in the circumferential direction includes a convex curved portion that is convex upward.

With the centrifugal compressor described in the above (5), at the winding end where the cross-sectional area of the scroll passage is relatively large and the increase in the outer radius R of the diffuser section has a relatively small effect on the cross-sectional shape of the scroll passage, the outer radius R of the diffuser section can be increased over a wide range in the circumferential direction. Accordingly, the efficiency improving effect of extending the outer radius R of the diffuser section can be effectively achieved, and a highly efficient centrifugal compressor can be obtained.

(6) In some embodiments, in the centrifugal compressor described in the above (4) or (5), a portion of the nonlinear increasing portion belonging to a range from 60° position to 210° position in the circumferential direction includes a convex curved portion that is convex downward.

With the centrifugal compressor described in the above (6), at the winding start where the cross-sectional area of the scroll passage is relatively small and the increase in the outer radius R of the diffuser section has a large effect on the cross-sectional shape of the scroll passage, the outer radius R of the diffuser section can be decreased over a wide range in the circumferential direction. Accordingly, the efficiency improving effect of extending the outer radius R of the diffuser section can be effectively achieved, and a highly efficient centrifugal compressor can be obtained.

(7) In some embodiments, in the centrifugal compressor described in any one of the above (1) to (6), in a cross-section perpendicular to a rotational axis of the impeller, a portion of an outer peripheral edge of the diffuser section connecting a position where the outer radius R is maximum and a position where the outer radius R is minimum is formed by a part of an ellipse.

With the centrifugal compressor described in the above (7), in the coordinate system determined by two coordinate axes perpendicular to the rotational axis of the impeller, the outer peripheral edge of the diffuser section can be smoothly connected in any of the two coordinates at the position where the outer radius R is maximum and at the position where the outer radius R is minimum. As a result, it is possible to form a flow field in which the static pressure does not change abruptly in the circumferential direction in the circumferential static pressure distribution of the scroll passage. Accordingly, it is possible to obtain a highly efficient centrifugal compressor.

(8) In some embodiments, in the centrifugal compressor described in the above (7), a center of the ellipse is eccentric with respect to the rotational axis of the impeller.

With the above configuration (8), the outer radius increasing portion can be formed over a wide range in the circumferential direction, so that it is possible to obtain a highly efficient centrifugal compressor.

(9) A turbocharger according to at least one embodiment of the present invention comprises the centrifugal compressor described in any one of the above (1) to (8).

With the turbocharger described in the above (9), since the centrifugal compressor described in any one of the above (1) to (8) is included, it is possible to obtain a highly efficient turbocharger.

Advantageous Effects

At least one embodiment of the present invention provides a highly efficient centrifugal compressor.

DETAILED DESCRIPTION

Embodiments of the present invention will now be described in detail with reference to the accompanying drawings. It is intended, however, that unless particularly identified, dimensions, materials, shapes, relative positions, and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
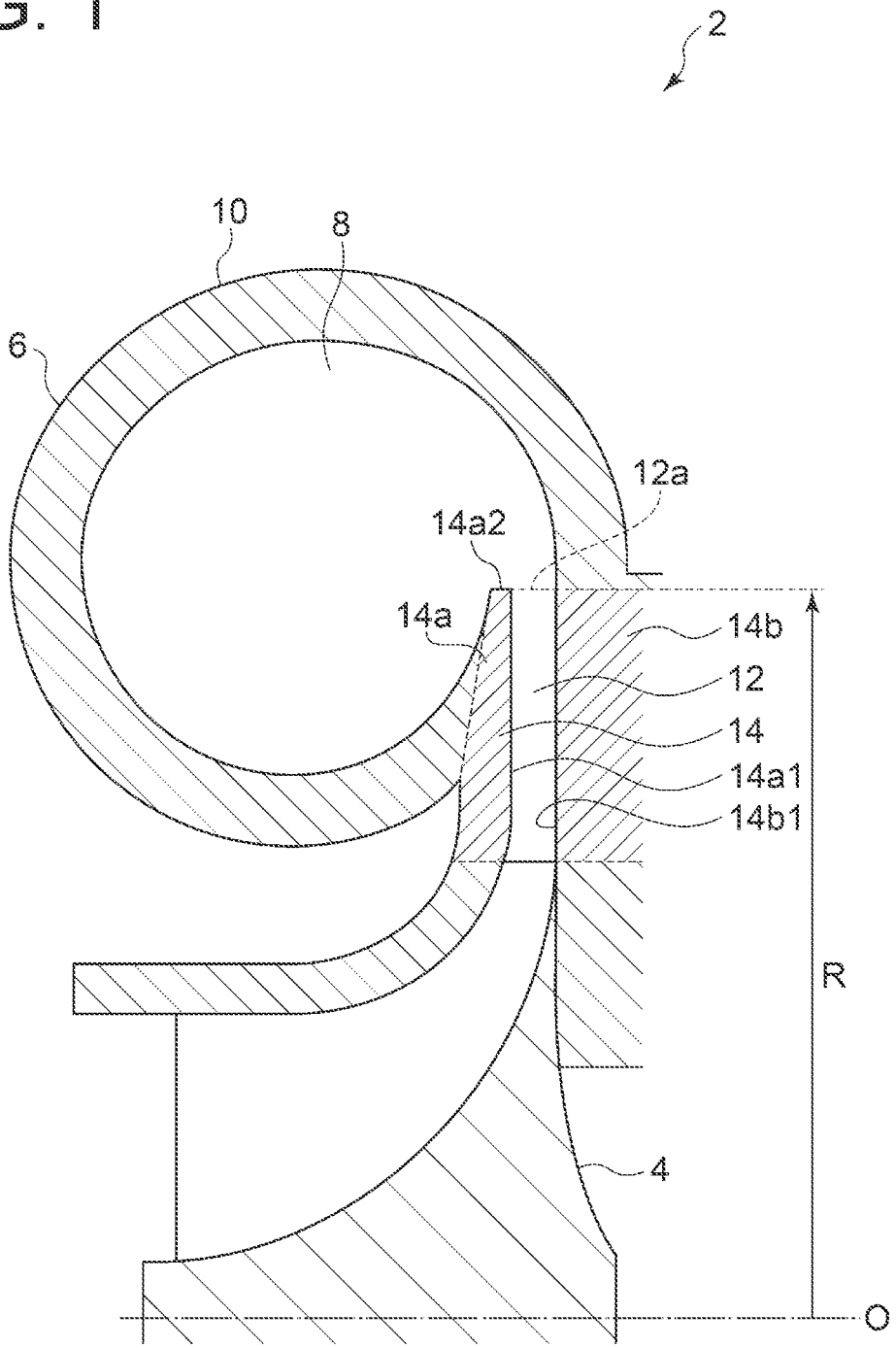
FIG. 1 is a schematic cross-sectional view of a centrifugal compressor 2 according to an embodiment, taken along the rotational axis O.
Figure 2:
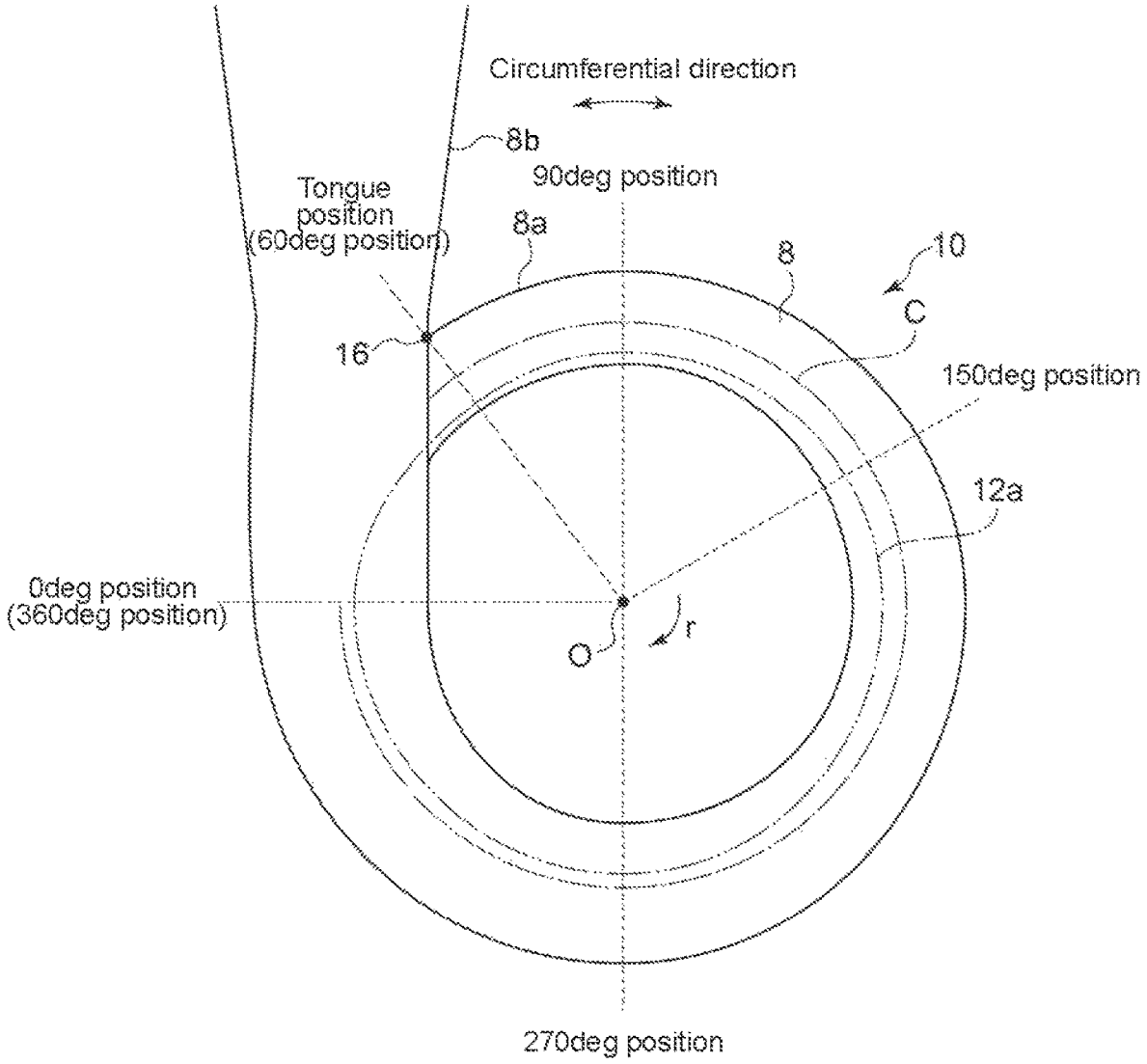
FIG. 2 is a schematic diagram of an example of a cross-section perpendicular to the axial direction of a scroll passage 8 of the centrifugal compressor 2 shown in FIG. 1.
Figure 3:
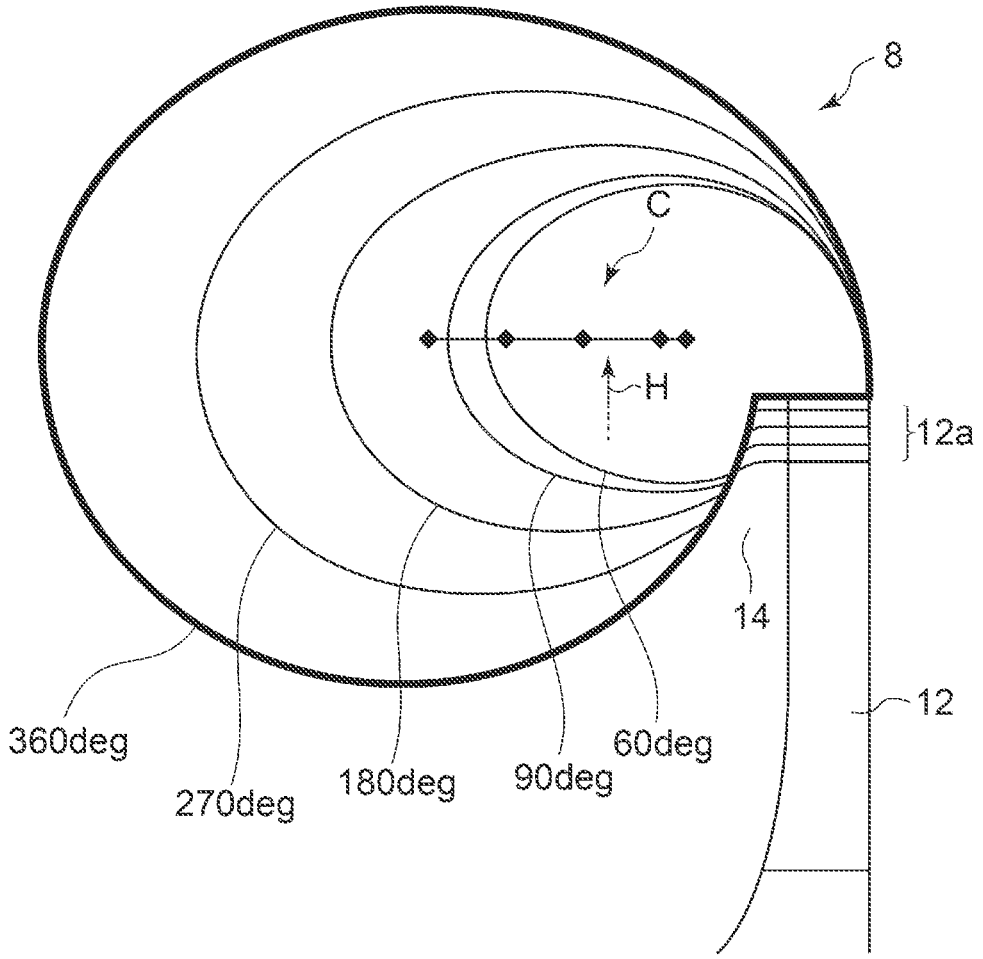
FIG. 3 is a diagram showing changes in cross-sectional shape of the scroll passage 8 at each predetermined angle in the circumferential direction of the centrifugal compressor 2 shown in FIG. 2.

FIG. 1 is a schematic cross-sectional view of a centrifugal compressor 2 according to an embodiment, taken along the rotational axis O. FIG. 2 is a schematic diagram of an example of a cross-section perpendicular to the axial direction of a scroll passage 8 of the centrifugal compressor 2 shown in FIG. 1. FIG. 3 is a diagram showing changes in cross-sectional shape of the scroll passage 8 at each predetermined angle in the circumferential direction of the centrifugal compressor 2 shown in FIG. 2. The centrifugal compressor 2 can be applied, for example, to turbochargers for automobiles or marine use, other industrial centrifugal compressors, blowers, etc.

For example, as shown in FIG. 1, the centrifugal compressor 2 includes an impeller 4 and a casing 6 housing the impeller 4. Hereinafter, the axial direction of the impeller 4 is referred to as merely "axial direction", and the radial direction of the impeller 4 is referred to as merely "radial direction", and the circumferential direction of the impeller 4 is referred to as merely "circumferential direction".

The casing 6 includes a scroll section 10 forming a scroll passage 8 on the outer peripheral side of the impeller 4, and a diffuser section 14 forming a diffuser passage 12 for supplying compressed air compressed by the impeller 4 to the scroll passage 8. In a cross-section along the rotational axis O of the impeller 4, the scroll passage 8 has a substantially circular shape, and the diffuser passage 12 is formed linearly along the radial direction.

The diffuser section 14 is composed of a pair of flow passage walls 14*a*, 14*b* forming the diffuser passage 12. A flow passage wall surface 14*a*1 of the flow passage wall 14*a* and a flow passage wall surface 14*b*1 of the flow passage wall 14*b* are formed linearly along the radial direction near the outlet 12*a* of the diffuser passage 12 in a cross-section along the rotational axis O.

In FIG. 1, the scroll section 10 and the diffuser section 14 are shaded with different kinds of hatching for convenience. Nevertheless, the casing 6 may include a plurality of casing parts connected via joints which may not necessarily be the boundary position between the scroll section 10 and the diffuser section 14. Furthermore, the casing 6 may include, in addition to a compressor housing which accommodates the impeller 4, a part of a bearing housing which accommodates a bearing rotatably supporting the impeller 4.

Here, as shown in FIG. 2, the position of the tongue 16 of the scroll section 10 in the circumferential direction (the connection position between the winding start 8*a* and the winding end 8*b* of the scroll passage 8) is defined as 60°, and the downstream direction in the rotational direction r of the impeller 4 is defined as the positive direction of the circumferential position. The circumferential position means the angular position around the rotational axis O of the impeller 4. Herein, the position of the tongue 16 is defined as 60° as the reference of the angular position.

As shown in FIG. 3, the flow passage cross-sectional area of the scroll passage 8 expands downstream in the rotational direction of the impeller 4 from the 60° position to the 360° position. Further, in the exemplary embodiment shown in FIG. 3, a distance H between the cross-sectional center C of the scroll passage and the rotational axis O (see FIG. 1) is constant from 60° to 360°.

Figure 4:
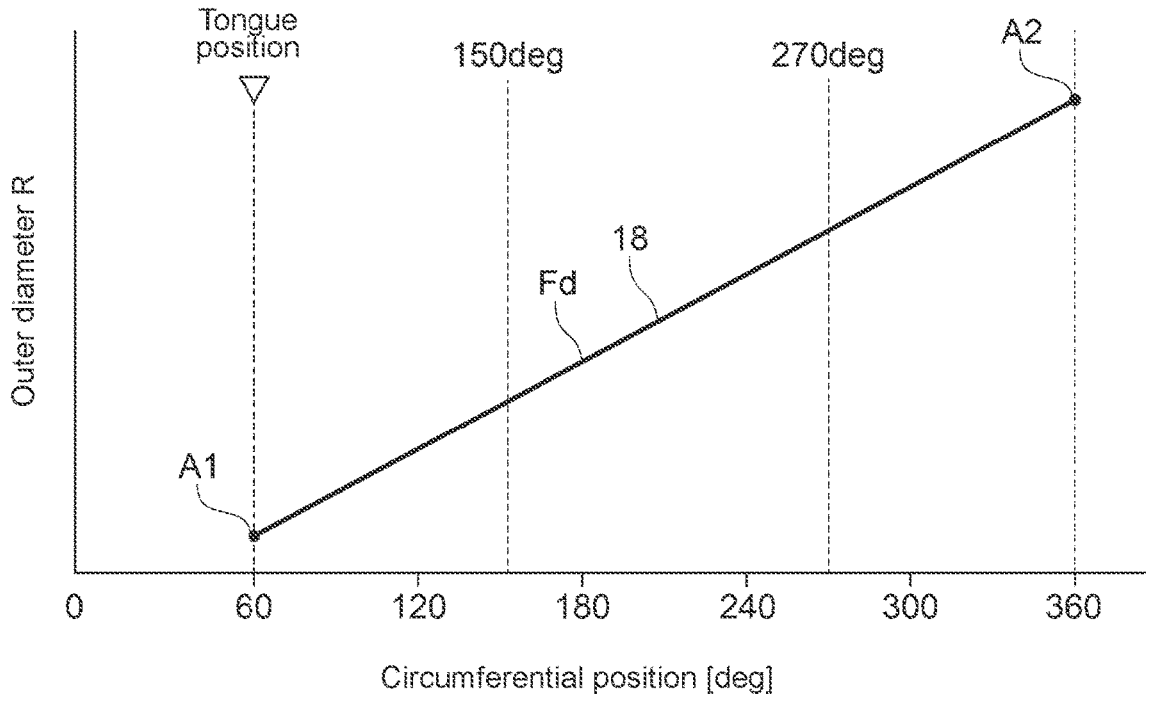
FIG. 4 is a diagram showing a diffuser section outer radius distribution Fd indicating a relationship between the circumferential position and the outer radius R of the diffuser section 14 according to an embodiment.

FIG. 4 is a diagram showing a diffuser section outer radius distribution Fd indicating a relationship between the circumferential position and the outer radius R of the diffuser section 14 according to an embodiment. The outer radius R of the diffuser section 14 means the distance R between the outlet 12*a* (see FIG. 1) of the diffuser passage 12 and the rotational axis O of the impeller 4, i.e., the distance R between the outer peripheral edge 14*a*2 of the flow passage wall 14*a* and the rotational axis O of the impeller 4.

As shown in FIG. 4, the diffuser section outer radius distribution Fd includes an outer radius increasing portion 18 where the outer radius R of the diffuser section 14 increases as it goes toward the positive direction in the circumferential direction. Further, in the diffuser section outer radius distribution Fd, the position A1 of the start point of the outer radius increasing portion 180 (angular position where the increase in the outer radius R starts) is 150° or less, and the position A2 of the end point of the outer radius increasing portion 18 (angular position θ where the increase in the outer radius R ends) is 270° or more. In the illustrated exemplary diffuser section outer radius distribution, the position A1 is 60°, the position A2 is 360°, and the outer radius R of the diffuser section 14 increases linearly from the position A1 to the position A2. Further, in the illustrated exemplary diffuser section outer radius distribution, A2-A1≥150° and A2-A1≥180° are satisfied.

The effect of setting the position A1 to 150° or less and the position A2 to 270° or more will be described in contrast to the three comparative examples shown in FIGS. 5A to 5C.

As described above, in order to reduce the pressure drop in the scroll passage and the downstream outlet passage of the centrifugal compressor, it is desirable to recover the pressure as much as possible in the diffuser passage. To this end, it is effective to increase the outer radius of the diffuser section. On the other hand, there is a limit to increasing the outer radius of the diffuser section, because increasing the outer radius of the diffuser section leads to an increase in the overall size of the centrifugal compressor and deterioration of mountability.

Figure 5A:
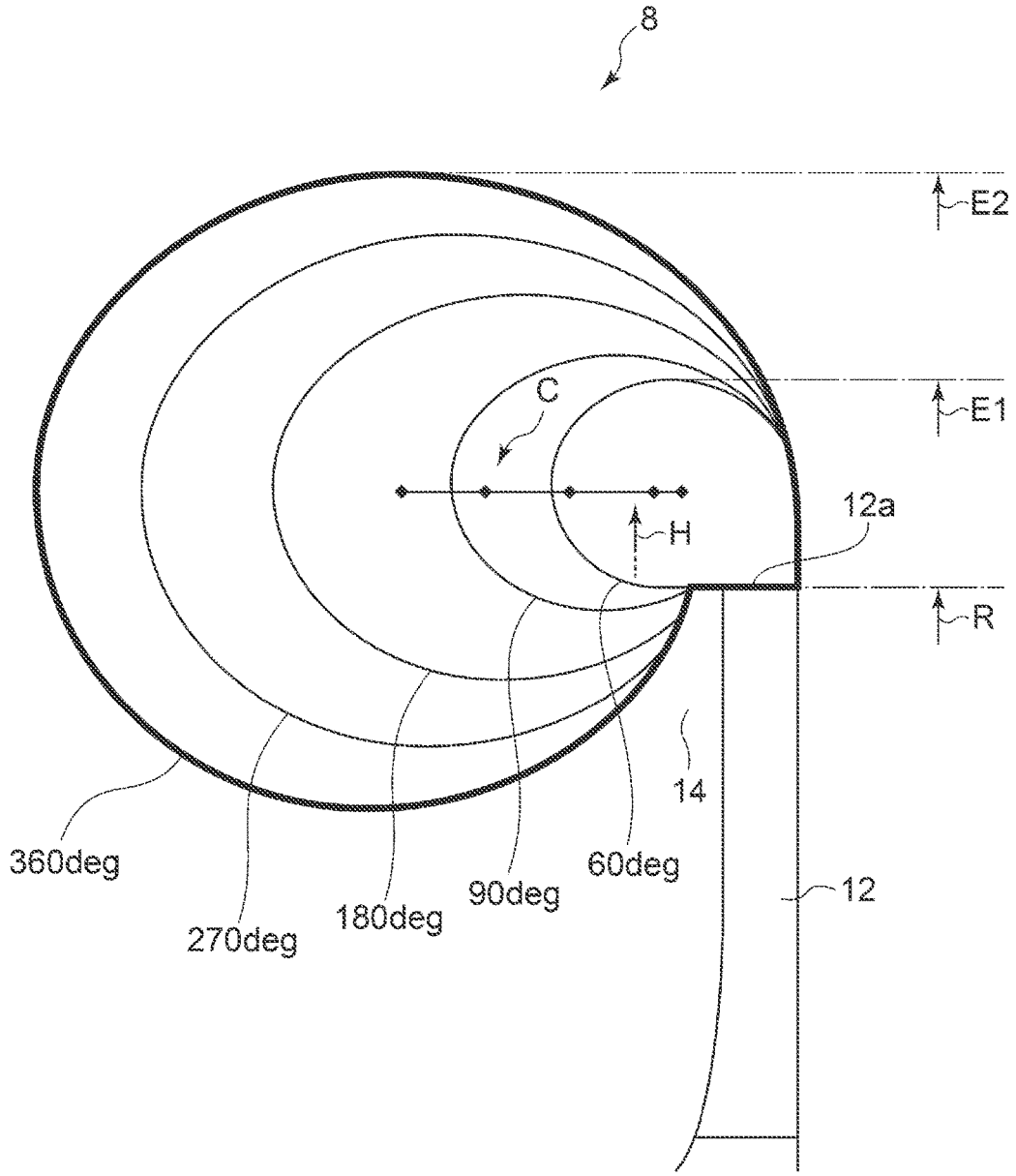
FIG. 5A is a diagram showing changes in cross-sectional shape of the scroll passage 8 at each predetermined angle in the circumferential direction of a centrifugal compressor according to a comparative example.
Figure 5B:
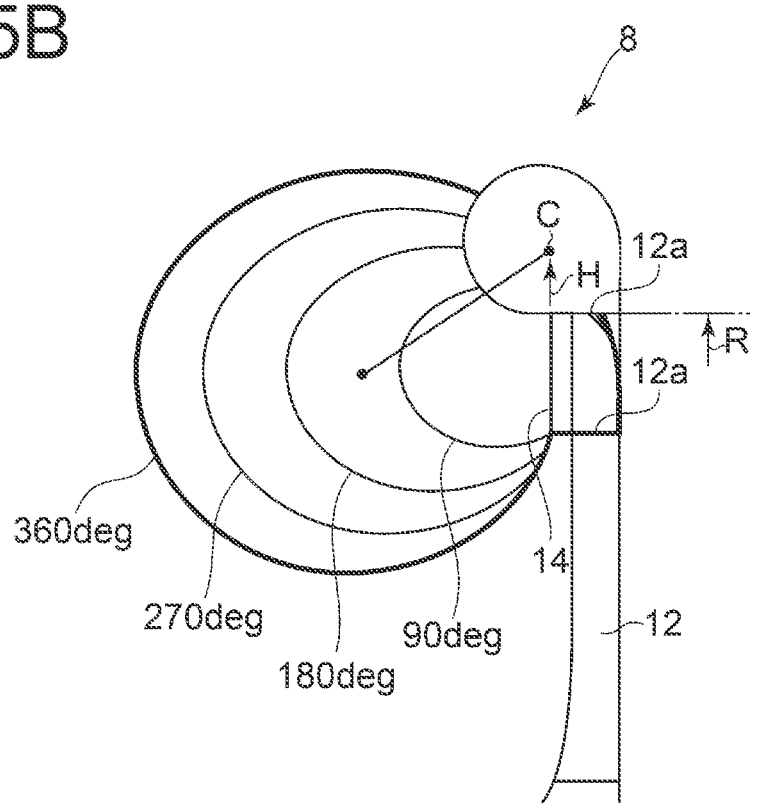
FIG. 5B is a diagram showing changes in cross-sectional shape of the scroll passage 8 at each predetermined angle in the circumferential direction of a centrifugal compressor according to another comparative example.
Figure 5C:
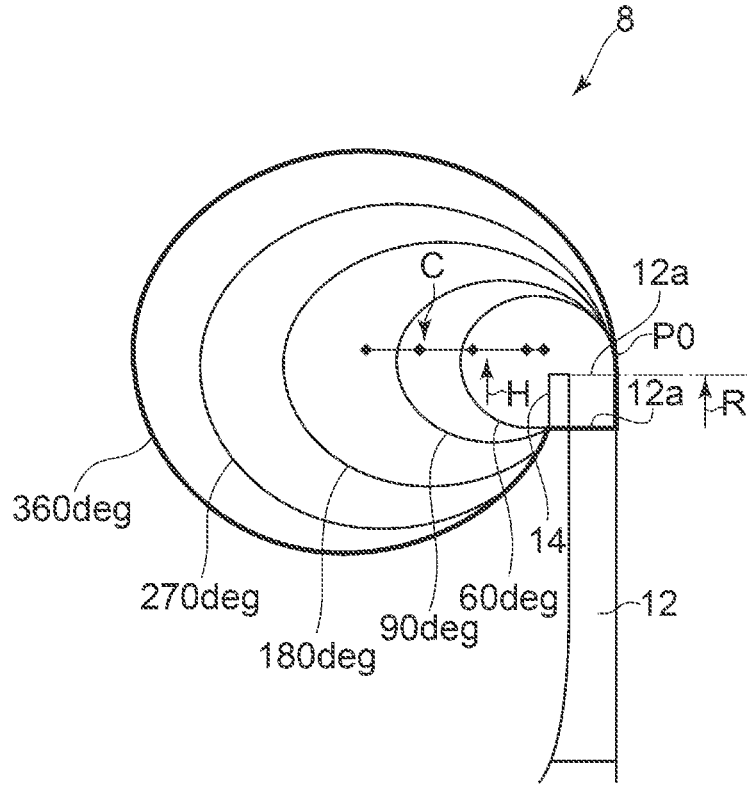
FIG. 5C is a diagram showing changes in cross-sectional shape of the scroll passage 8 at each predetermined angle in the circumferential direction of a centrifugal compressor according to another comparative example.

In a typical centrifugal compressor, as shown in FIG. 5A, the outer radius E1 at the winding start of the scroll passage 8 is smaller than the outer radius E2 (maximum outer radius) at the winding end of the scroll passage 8. In contrast to the configuration shown in FIG. 5A, if the outer radius R of the diffuser section 14 is simply increased at the winding start as shown in FIG. 5B, the distance H between the cross-sectional center C of the scroll passage 8 and the rotational axis O of the impeller 4 gradually decreases from the winding start to the winding end. In this case, the flow that decelerates and recovers the pressure at the winding start of the scroll passage 8 accelerates again and decreases the pressure toward the winding end, which increases the pressure drop and reduces the efficiency.

For this reason, it is preferable to extend only the outer radius R of the diffuser section 14 while keeping the distance H between the cross-sectional center C of the scroll passage 8 and the rotational axis O of the impeller 4 constant in the circumferential direction, but creating such a shape is fraught with difficulties. As shown in FIG. 5C, when the outer radius R of the diffuser section 14 is extended without changing the outer radius dimension of the scroll passage 8 from the configuration shown in FIG. 5A, the extension limit of the outer radius R of the diffuser section 14 is determined by the position PO where the curvature of the cross-section of the scroll passage 8 starts. This is because if the outer radius R of the diffuser section 14 is expanded any further, the diffuser passage 12 is narrowed as it goes outward in the radial direction due to the curvature of the wall surface forming the scroll passage 8. Further, if the outer radius R of the diffuser section 14 is extended as shown in FIG. 5C, the cross-sectional shape of the scroll passage 8, especially at the winding start where the cross-sectional area is small, changes significantly, and the cross-sectional shape of the scroll passage 8 becomes far from circular, resulting in an increase in pressure drop at the winding start of the scroll passage 8.

In contrast, in the embodiment shown in FIG. 4, as described above, the position A1 of the start point of the outer radius increasing portion 18 is 150° or less, and the position A2 of the end point of the outer radius increasing portion 18 is 270° or more. With this configuration, the outer radius R of the diffuser section 14 can be made smaller at the winding start (position at 150° or less) where the cross-sectional area of the scroll passage 8 is relatively small and the increase in the outer radius R of the diffuser section 14 has a large effect on the cross-sectional shape, while the outer radius R of the diffuser section 14 can be made larger at the winding end (position at 270° or more) where the cross-sectional area of the scroll passage 8 is relatively large and the increase in the outer radius R of the diffuser section 14 has a relatively small effect on the cross-sectional shape. Accordingly, the efficiency improving effect of extending the outer radius R of the diffuser section 14 can be effectively achieved, and a highly efficient centrifugal compressor can be obtained. Further, when A2-A1≥150° (more preferably A2-A1≥180°) is satisfied, the efficiency improving effect can be further improved.

Figure 6:
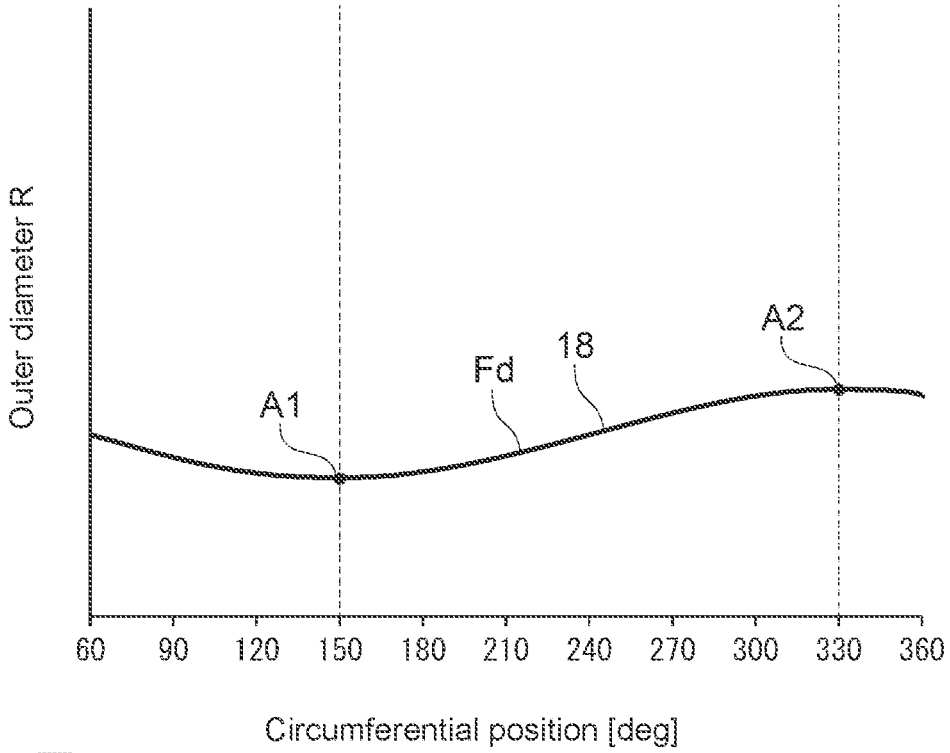
FIG. 6 is a diagram showing another example of a diffuser section outer radius distribution Fd indicating a relationship between the circumferential position and the outer radius R of the diffuser section 14 according to another embodiment.
Figure 7:
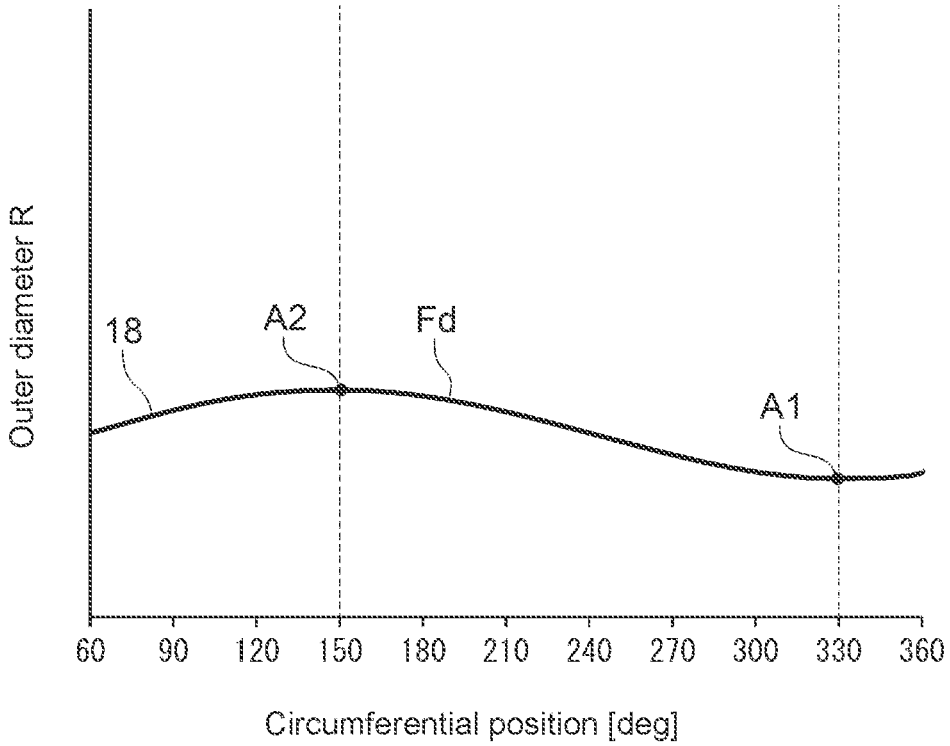
FIG. 7 is a diagram showing a diffuser section outer radius distribution Fd indicating a relationship between the circumferential position and the outer radius R of the diffuser section 14 according to a comparative example.

FIG. 6 is a diagram showing another example of a diffuser section outer radius distribution Fd indicating a relationship between the circumferential position and the outer radius R of the diffuser section 14 according to another embodiment. FIG. 7 is a diagram showing a diffuser section outer radius distribution Fd indicating a relationship between the circumferential position and the outer radius R of the diffuser section 14 according to a comparative example.

In the embodiment shown in FIG. 6, the diffuser section outer radius distribution Fd has a sinusoidal waveform shape, the position A1 of the start point of the outer radius increasing portion 18 is 150°, and the position A2 of the end point of the outer radius increasing portion 18 is 330°. Therefore, in the diffuser section outer radius distribution Fd shown in FIG. 6, as in the diffuser section outer radius distribution Fd shown in FIG. 4, the position A1 is 150° or less, the position A2 is 270° or less, and A2-A1≥150° and A2-A1≥180° are satisfied.

In the comparative example shown in FIG. 7, the diffuser section outer radius distribution Fd has a sinusoidal waveform shape but is 180° out of phase with the diffuser section outer radius distribution Fd shown in FIG. 6. Accordingly, in the diffuser section outer radius distribution Fd shown in FIG. 7, the outer radius R of the diffuser section 14 decreases from 150° to 330°.

Figure 8:
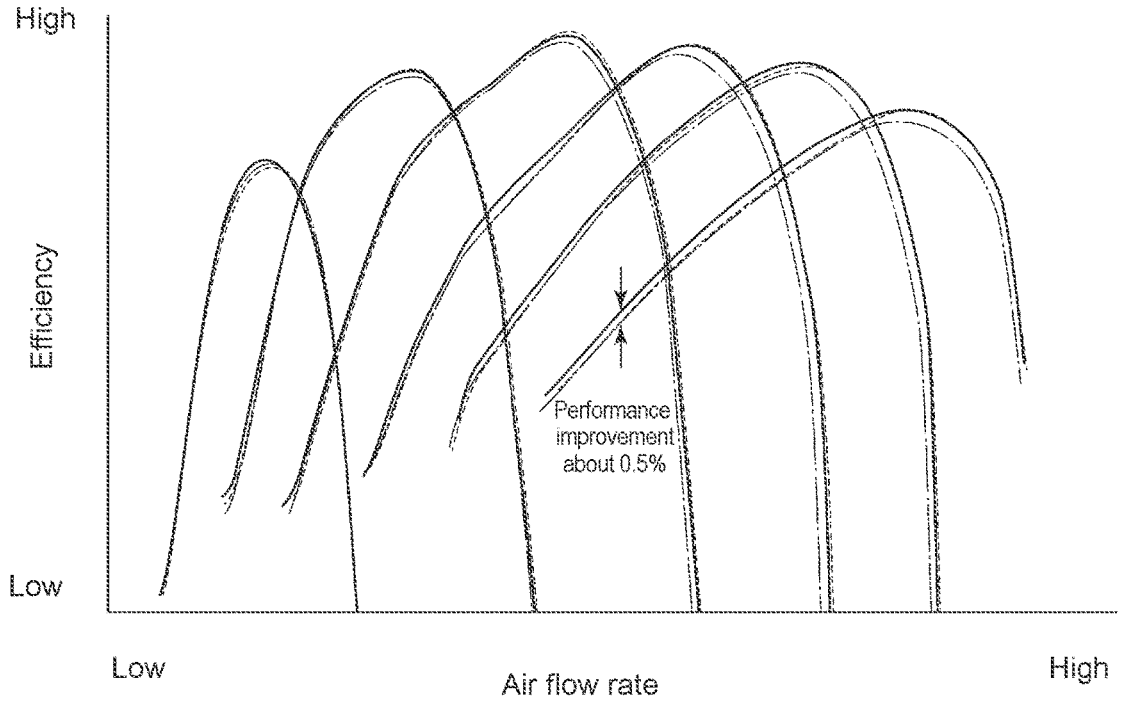
FIG. 8 is a diagram showing a relationship between the air flow rate and efficiency of the centrifugal compressor in the embodiment shown in FIG. 6, the comparative example shown in FIG. 7, and the comparative example shown in FIG. 5A for each rotational speed of the centrifugal compressor.

FIG. 8 is a diagram showing a relationship between the air flow rate and efficiency of the centrifugal compressor in the embodiment shown in FIG. 6, the comparative example shown in FIG. 7, and the comparative example shown in FIG. 5A for each rotational speed of the centrifugal compressor. In FIG. 8, the solid line indicates the performance test results of the embodiment shown in FIG. 6, the dashed line indicates the performance test results of the comparative example shown in FIG. 7, and the dash-dotted line indicates the performance test results of the comparative example shown in FIG. 5A. The performance test results shown in FIG. 8 indicate that the embodiment where the position A1 is 150° or less and the position A2 is 270° or more can improve the efficiency by about 0.5% compared to the other two comparative examples.

Next, with reference to FIGS. 9 to 12, other embodiments will be described.

Figure 9:
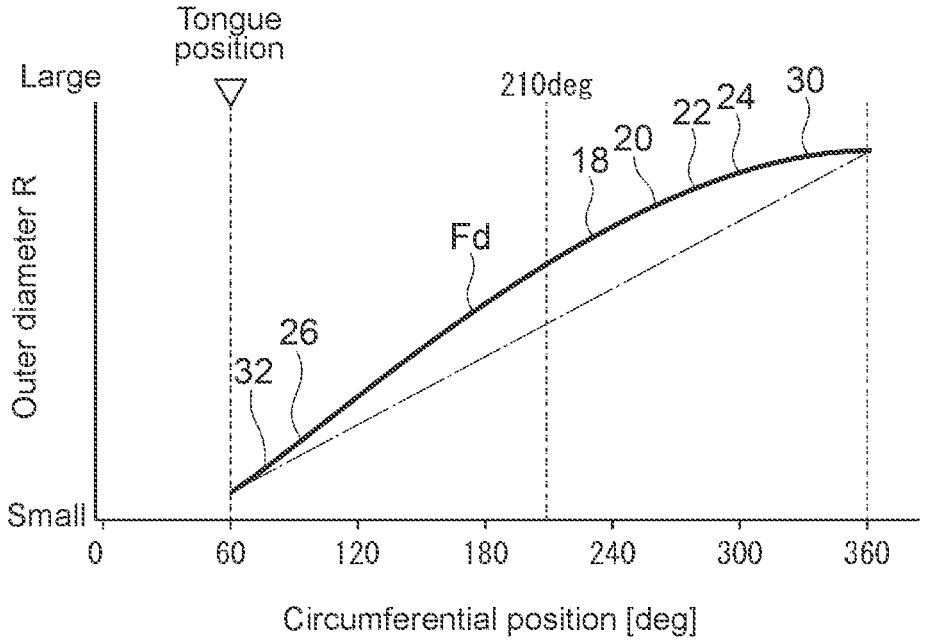
FIG. 9 is a diagram showing a diffuser section outer diameter distribution Fd indicating a relationship between the circumferential position and the outer diameter R of the diffuser section 14 according to another embodiment.
Figure 10:
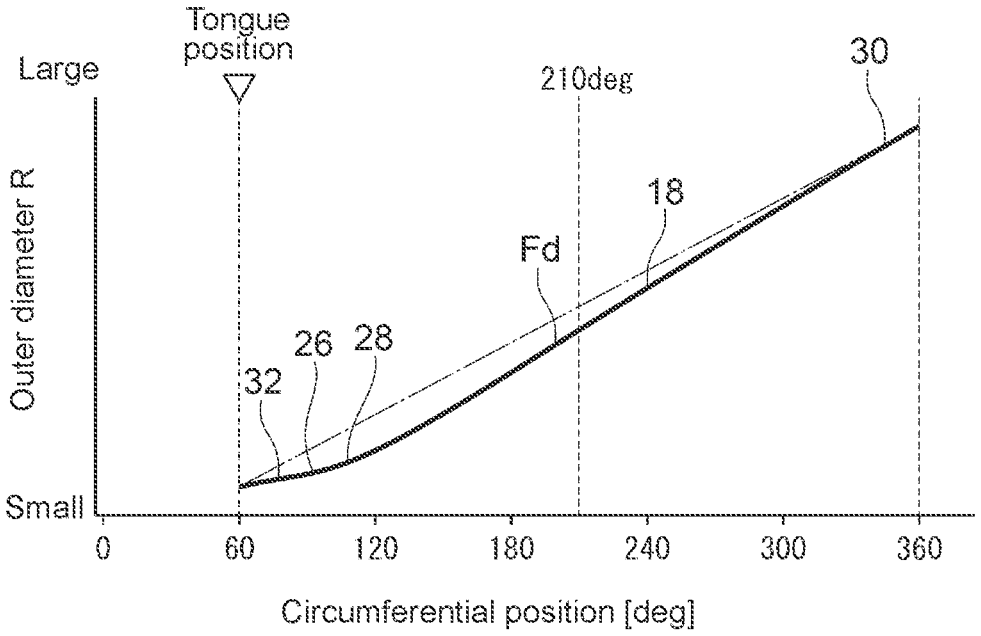
FIG. 10 is a diagram showing a diffuser section outer radius distribution Fd indicating a relationship between the circumferential position and the outer radius R of the diffuser section 14 according to another embodiment.
Figure 11:
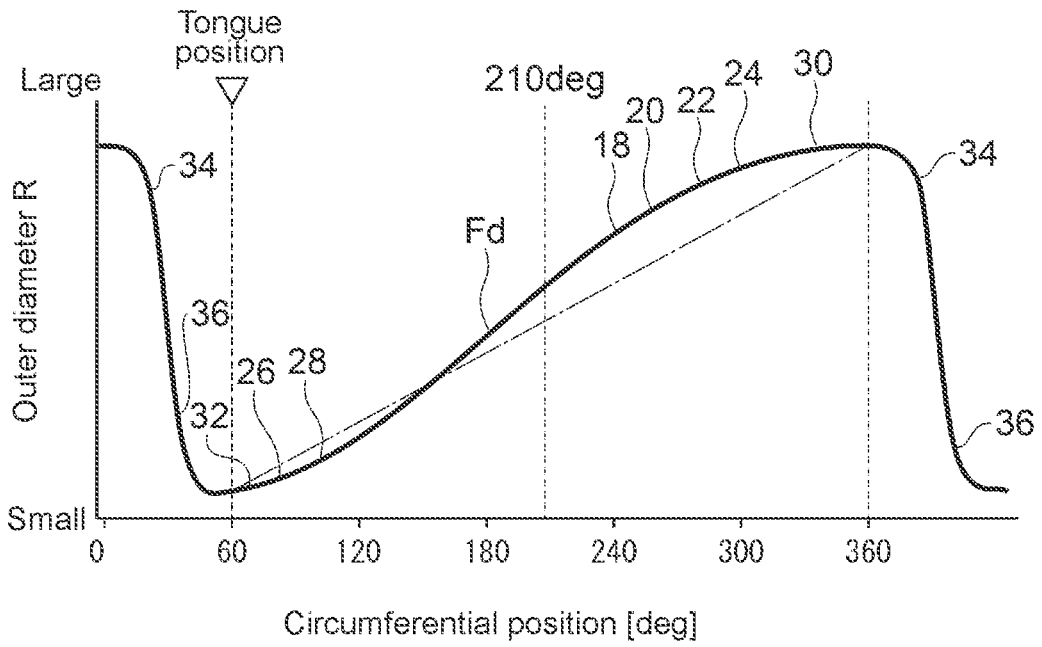
FIG. 11 is a diagram showing a diffuser section outer radius distribution Fd indicating a relationship between the circumferential position and the outer radius R of the diffuser section 14 according to another embodiment.

FIG. 9 is a diagram showing a diffuser section outer radius distribution Fd indicating a relationship between the circumferential position and the outer radius R of the diffuser section 14 according to another embodiment. FIG. 10 is a diagram showing a diffuser section outer radius distribution Fd indicating a relationship between the circumferential position and the outer radius R of the diffuser section 14 according to another embodiment. FIG. 11 is a diagram showing a diffuser section outer radius distribution Fd indicating a relationship between the circumferential position and the outer radius R of the diffuser section 14 according to another embodiment.

In the embodiments shown in FIGS. 9 to 11, similarly, in the diffuser section outer radius distribution Fd, the position A1 of the start point of the outer radius increasing portion 18 is 150° or less, and the position A2 of the end point of the outer radius increasing portion 18 is 270° or more. The position A1 is 60°, the position A2 is 360°, and A2-A1≥150° and A2-A1≥180° are satisfied.

In some embodiments, for example as shown in FIGS. 9 to 11, the outer radius increasing portion 18 includes a nonlinear increasing portion 20 where the outer radius R of the diffuser section 14 nonlinearly increases going toward the positive direction.

In some embodiments, for example as shown in FIGS. 9 to 11, a portion 22 of the nonlinear increasing portion 20 belonging to a range from the 210° position to the 360° position in the circumferential direction includes a convex curved portion 24 that is convex upward.

With this configuration, at the winding end where the cross-sectional area of the scroll passage 8 is relatively large and the increase in the outer radius R of the diffuser section 14 has a relatively small effect on the cross-sectional shape, the outer radius R of the diffuser section 14 can be increased over a wide range in the circumferential direction. Accordingly, the efficiency improving effect of extending the outer radius R of the diffuser section 14 can be effectively achieved, and a highly efficient centrifugal compressor can be obtained.

In some embodiments, for example as shown in FIGS. 10 and 11, a portion 26 of the nonlinear increasing portion 20 belonging to a range from the 60° position to the 210° position in the circumferential direction includes a convex curved portion 28 that is convex downward.

With this configuration, at the winding start where the cross-sectional area of the scroll passage 8 is relatively small and the increase in the outer radius R of the diffuser section 14 has a large effect on the cross-sectional shape, the outer radius R of the diffuser section 14 can be decreased over a wide range in the circumferential direction. Accordingly, the efficiency improving effect of extending the outer radius R of the diffuser section 14 can be effectively achieved, and a highly efficient centrifugal compressor can be obtained.

In some embodiments, for example as shown in FIG. 11, the diffuser section outer radius distribution Fd has an S-shape in a range from the 60° position to the 360° position in the circumferential direction.

With this configuration, at the winding end where the cross-sectional area of the scroll passage 8 is relatively large and the increase in the outer radius R of the diffuser section 14 has a relatively small effect on the cross-sectional shape, the outer radius R of the diffuser section 14 can be increased over a wide range in the circumferential direction. Further, at the winding start where the cross-sectional area of the scroll passage 8 is relatively small and the increase in the outer radius R of the diffuser section 14 has a large effect on the cross-sectional shape, the outer radius R of the diffuser section 14 can be decreased over a wide range in the circumferential direction. Accordingly, the efficiency improving effect of extending the outer raidus R of the diffuser section 14 can be effectively achieved, and a highly efficient centrifugal compressor can be obtained.

In some embodiments, for example as shown in FIG. 11, a large diameter portion 30 at the winding end and a small radius portion 32 at the winding start in the diffuser section outer radius distribution Fd are connected by a smooth line with no bending point. In the exemplary embodiment shown in FIG. 11, the diffuser section outer radius distribution Fd includes a convex curved portion 34 that is convex upward and a convex curved portion 36 that is convex downward between the 360° position and the 60° position on the positive side of the 360° (0°) position. As a result, it is possible to form a flow field in which the circumferential static pressure distribution does not change abruptly. In some embodiments, the diffuser section outer radius distribution Fd shown in FIGS. 4, 6, 9 and 10 may include a convex curved portion 34 that is convex upward and a convex curved portion 36 that is convex downward between the 360° position and the 60° position, as with the diffuser section outer radius distribution Fd shown in FIG. 11.

Figure 12:
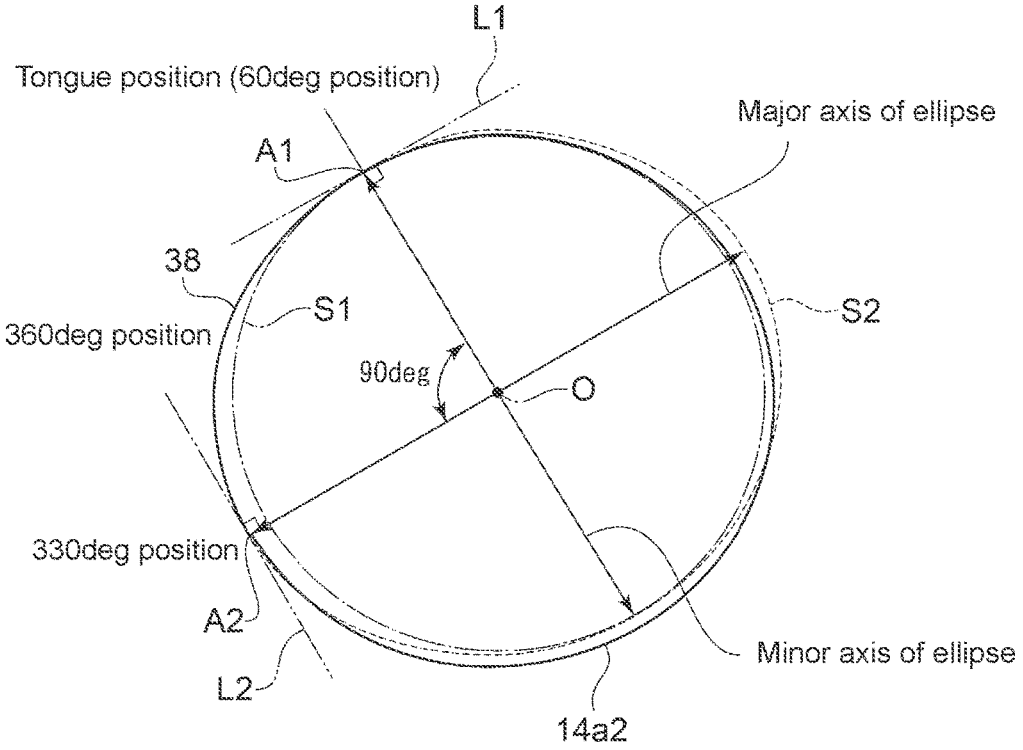
FIG. 12 is a diagram showing the outer peripheral edge 14*a*2 of the diffuser section 14 (outer peripheral edge 14*a*2 of flow passage wall 14*a*) in a cross-section perpendicular to the rotational axis O of the impeller 4 according to another embodiment.
Figure 13:
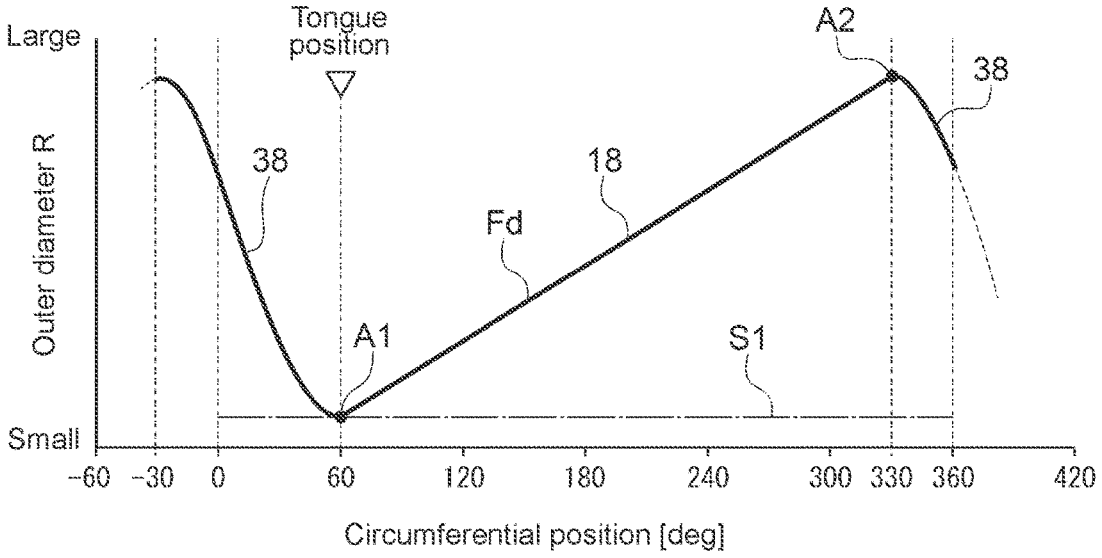
FIG. 13 is a diagram showing a diffuser section outer radius distribution Fd of the diffuser section 14 shown in FIG. 12.
Figure 14:
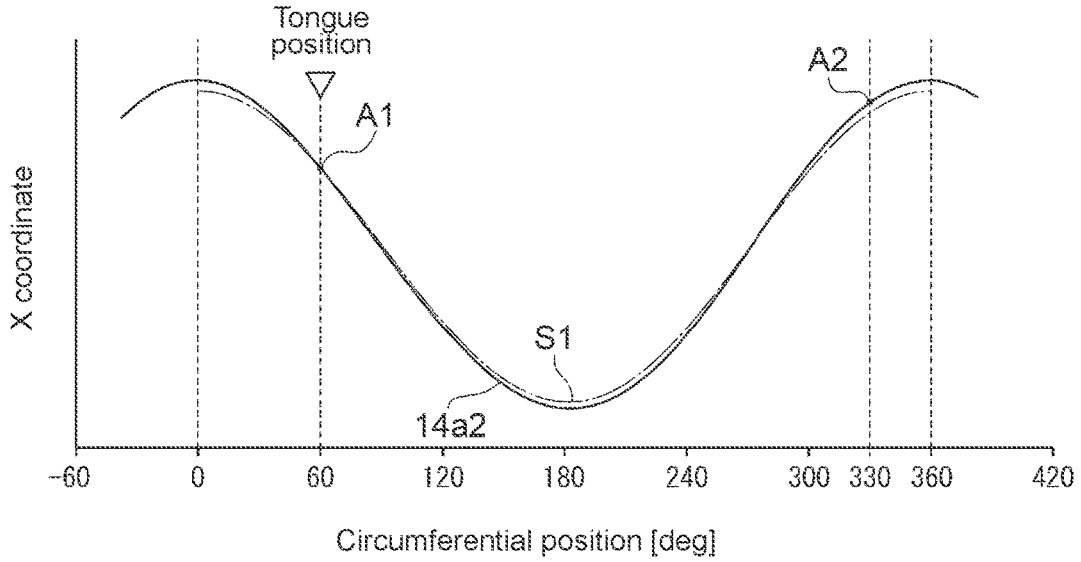
FIG. 14 is a diagram showing a relationship between the circumferential position and the X coordinate of the reference circle S1 and the outer peripheral edge 14*a*2 shown in FIG. 12.
Figure 15:
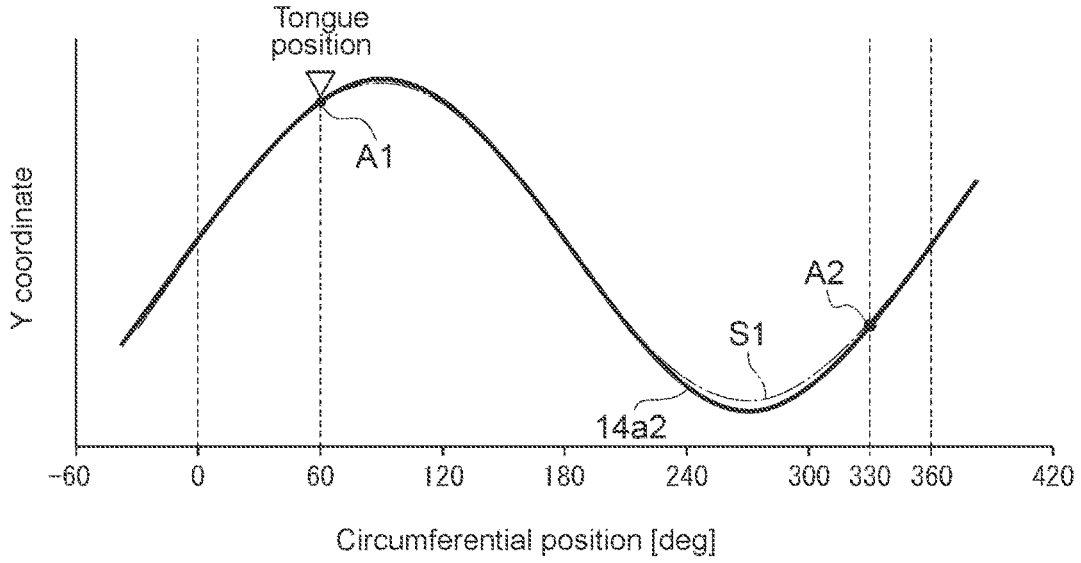
FIG. 15 is a diagram showing a relationship between the circumferential position and the Y coordinate of the reference circle S and the outer peripheral edge 14*a*2 shown in FIG. 12.

FIG. 12 is a diagram showing the outer peripheral edge 14*a*2 of the diffuser section 14 (outer peripheral edge 14*a*2 of flow passage wall 14*a*) in a cross-section perpendicular to the rotational axis O of the impeller 4 according to another embodiment. FIG. 13 is a diagram showing a diffuser section outer radius distribution Fd of the diffuser section 14 shown in FIG. 12. FIG. 14 is a diagram showing a relationship between the circumferential position and the X coordinate of the reference circle S1 and the outer peripheral edge 14*a*2 shown in FIG. 12. FIG. 15 is a diagram showing a relationship between the circumferential position and the Y coordinate of the reference circle S1 and the outer peripheral edge 14*a*2 shown in FIG. 12. In the exemplary embodiment shown in FIG. 12, the 0° (360°) position is the positive direction of the X coordinate, and the 90° position is the positive direction of the Y coordinate.

In FIG. 12, the solid line indicates the outer peripheral edge 14*a*2 of the diffuser section 14 according to an embodiment, the dash-dotted line indicates a reference circle S1 centered on the rotational axis O of the impeller 4, and the dashed line indicates an ellipse S2 centered on the rotational axis O of the impeller 4.

As shown in FIG. 12, the outer peripheral edge 14*a*2, the reference circle S1, and the ellipse S2 share a tangent line L1 at the 60° position. Further, the outer peripheral edge 14*a*2 and the ellipse S2 share a tangent line L2 at the 330° position. The major axis of the ellipse S2 passes through the 150° and 330° positions, and the minor axis of the ellipse S2 passes through the 60° and 240° positions.

In the diffuser section outer radius distribution Fd shown in FIG. 13, the position A1 of the start point of the outer radius increasing portion 18 is 150° or less, and the position A2 of the end point of the outer radius increasing portion 18 is 270° or more. The position A1 is 60°, the position A2 is 330°, and the outer radius R of the diffuser section 14 increases linearly from the position A1 to the position A2. Further, A2-A1≥150° and A2-A1≥180° are satisfied.

In some embodiments, as shown in FIG. 12, in a cross-section perpendicular to the rotational axis O of the impeller 4, a portion 38 of the outer peripheral edge 14*a*2 of the diffuser section 14 connecting the position A2 where the outer radius R is maximum and the position A1 where the outer radius R is minimum (portion on the positive side of the position A2 and on the negative side of the position A1) is formed by a part of the ellipse S2.

With this configuration, in the coordinate system determined by the X and Y axes perpendicular to the rotational axis of the impeller 4, as shown in FIGS. 14 and 15, the outer peripheral edge 14*a*2 can be smoothly connected in any of the X and Y coordinates at the position A2 where the outer radius R is maximum and at the position A1 where the outer radius R is minimum. As a result, it is possible to form a flow field in which the static pressure does not change abruptly in the circumferential direction in the circumferential static pressure distribution of the scroll passage 8. Accordingly, it is possible to obtain a highly efficient centrifugal compressor 2.

Figure 16:
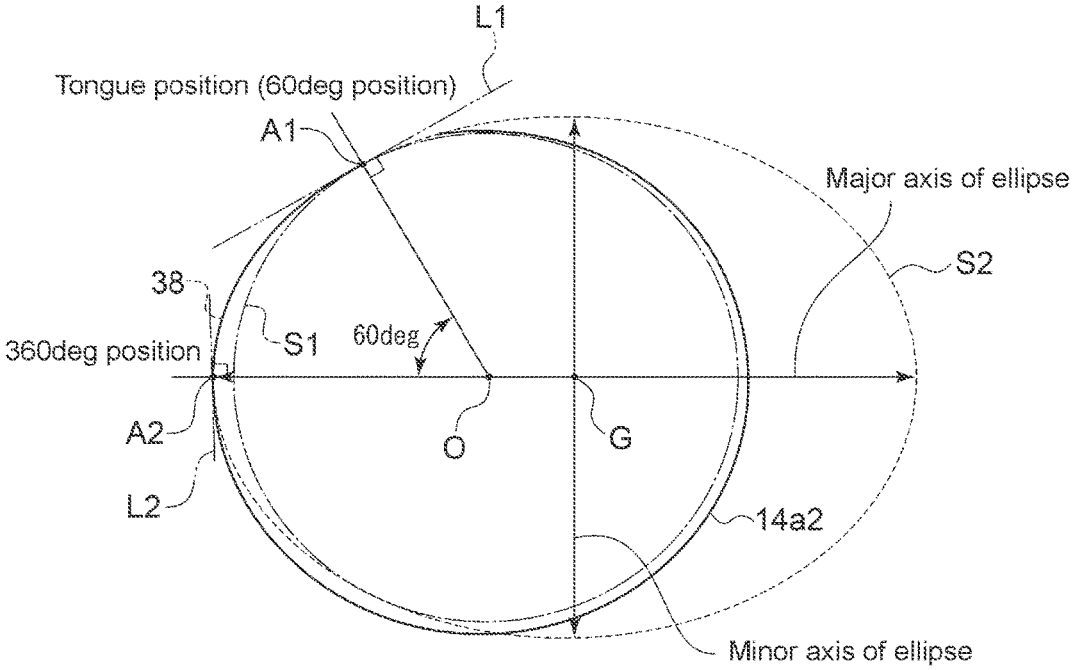
FIG. 16 is a diagram showing the outer peripheral edge 14*a*2 of the diffuser section 14 (outer peripheral edge 14*a*2 of flow passage wall 14*a*) in a cross-section perpendicular to the rotational axis O of the impeller 4 according to another embodiment.
Figure 17:
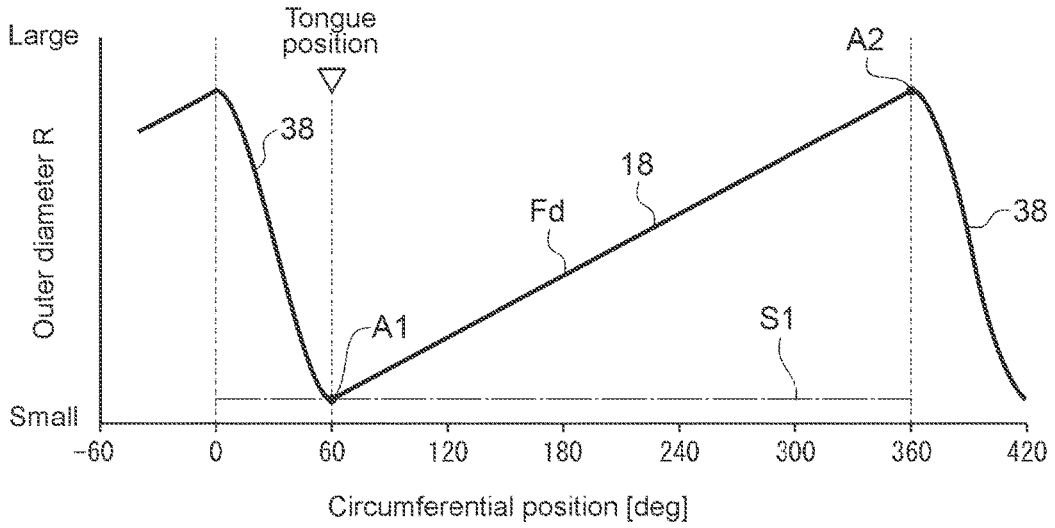
FIG. 17 is a diagram showing a diffuser section outer radius distribution Fd of the diffuser section 14 shown in FIG. 16.
Figure 18:
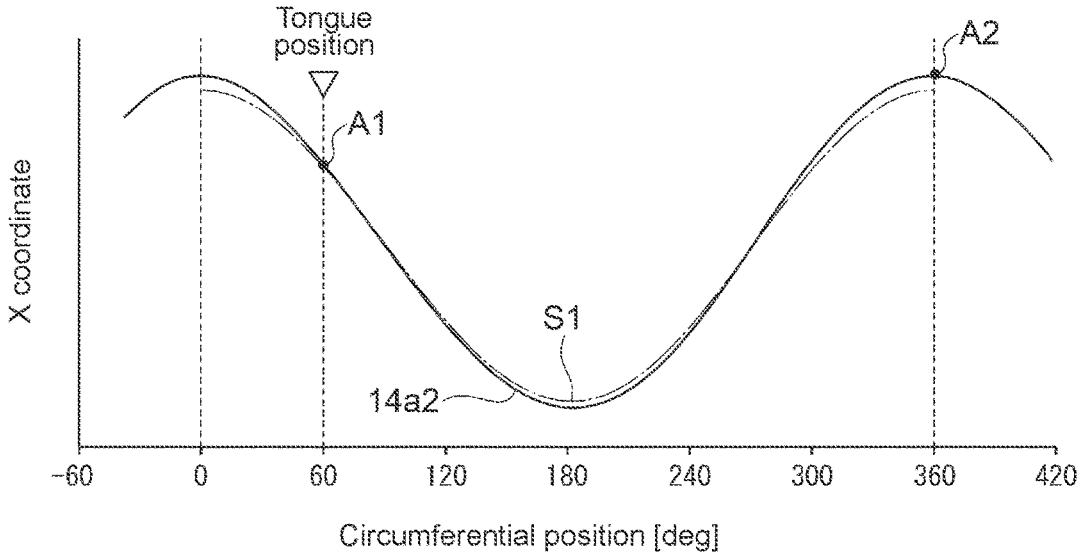
FIG. 18 is a diagram showing a relationship between the circumferential position and the X coordinate of the reference circle S1 and the outer peripheral edge 14*a*2 shown in FIG. 16.
Figure 19:
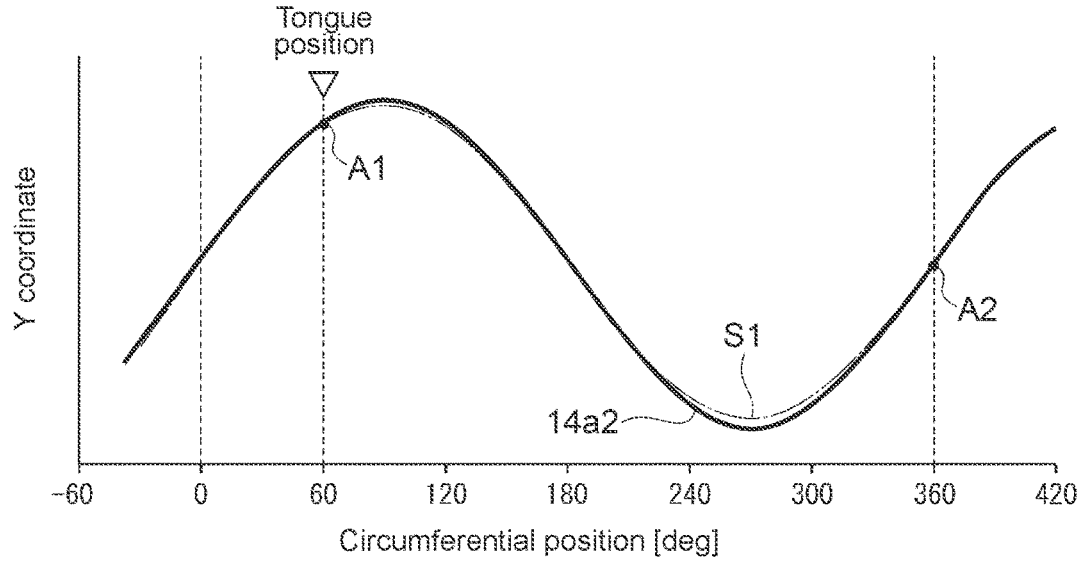
FIG. 19 is a diagram showing a relationship between the circumferential position and the Y coordinate of the reference circle S and the outer peripheral edge 14*a*2 shown in FIG. 16.

FIG. 16 is a diagram showing the outer peripheral edge 14*a*2 of the diffuser section 14 (outer peripheral edge 14*a*2 of flow passage wall 14*a*) in a cross-section perpendicular to the rotational axis O of the impeller 4 according to another embodiment. FIG. 17 is a diagram showing a diffuser section outer radius distribution Fd of the diffuser section 14 shown in FIG. 16. FIG. 18 is a diagram showing a relationship between the circumferential position and the X coordinate of the reference circle S1 and the outer peripheral edge 14*a*2 shown in FIG. 16. FIG. 19 is a diagram showing a relationship between the circumferential position and the Y coordinate of the reference circle S1 and the outer peripheral edge 14*a*2 shown in FIG. 16. In the exemplary embodiment shown in FIG. 16, the 0° (360°) position is the positive direction of the X coordinate, and the 90° position is the positive direction of the Y coordinate.

In FIG. 16, the solid line indicates the outer peripheral edge 14*a*2 of the diffuser section 14 according to an embodiment, the dash-dotted line indicates a reference circle S1 centered on the rotational axis O of the impeller 4, and the dashed line indicates an ellipse S2 with a center G eccentric in the negative direction of the X coordinate from the rotational axis O of the impeller 4.

As shown in FIG. 16, the outer peripheral edge 14*a*2, the reference circle S1, and the ellipse S2 share a tangent line L1 at the 60° position. Further, the outer peripheral edge 14*a*2 and the ellipse S2 share a tangent line L2 at the 360° position. The major axis of the ellipse S2 passes through the 180° and 360° positions.

In the diffuser section outer radius distribution Fd shown in FIG. 17, the position A1 of the start point of the outer radius increasing portion 18 is 150° or less, and the position A2 of the end point of the outer radius increasing portion 18 is 270° or more. The position A1 is 60°, the position A2 is 360°, and the outer radius R of the diffuser section 14 increases linearly from the position A1 to the position A2. Further, A2-A1≥150° and A2-A1≥180° are satisfied.

In some embodiments, as shown in FIG. 16, in a cross-section perpendicular to the rotational axis O of the impeller 4, a portion 38 of the outer peripheral edge 14*a*2 of the diffuser section 14 connecting the position A2 where the outer radius R is maximum and the position A1 where the outer radius R is minimum (portion on the positive side of the position A2 and on the negative side of the position A1) is formed by a part of the ellipse S2.

With this configuration, in the coordinate system determined by the X and Y axes perpendicular to the rotational axis of the impeller 4, as shown in FIGS. 14 and 15, the outer peripheral edge 14*a*2 can be smoothly connected in any of the X and Y coordinates at the position A2 where the outer radius R is maximum and at the position A1 where the outer radius R is minimum. As a result, it is possible to form a flow field in which the static pressure does not change abruptly in the circumferential direction in the circumferential static pressure distribution of the scroll passage. Further, since the center G of the ellipse S2 is eccentric with respect to the rotational axis O of the impeller 4, the outer radius increasing portion 18 can be formed over a wide range in the circumferential direction. Accordingly, it is possible to obtain a highly efficient centrifugal compressor.

The present invention is not limited to the embodiments described above, but includes modifications to the embodiments described above, and embodiments composed of combinations of those embodiments.

REFERENCE SIGNS LIST

2 Centrifugal compressor
4 Impeller
6 Casing
8 Scroll passage
8*a* Winding start
10 Scroll section
12 Diffuser passage
14 Diffuser section
14*a*2 Outer peripheral edge
14*a* Flow passage wall
14*a*, 14*b* Flow passage wall
14*a* Passage wall
14*a*, 14*b* Passage wall
14*a*1, 14*b*1 Flow passage wall surface
16 Tongue
18 Outer radius increasing portion
20 Nonlinear increasing portion
22, 26, 38 Portion
24, 28, 34, 36 Convex curved portion
30 Large radius portion
32 Small radius portion

The invention claimed is:

1. A centrifugal compressor, comprising an impeller and a casing, the casing including:

a scroll section forming a scroll passage on an outer peripheral side of the impeller; and a diffuser section forming a diffuser passage for supplying compressed air compressed by the impeller to the scroll passage, wherein, when a position of a tongue of the scroll section in a circumferential direction of the impeller is defined as 60°, and a downstream direction in a rotation direction of the impeller is defined as a positive direction of a position in the circumferential direction, a diffuser section outer radius distribution indicating a relationship between the position in the circumferential direction and outer radius R of the diffuser section includes an outer radius increasing portion where the outer radius R increases going toward the positive direction, the outer radius increasing portion being configured such that the outer radius R continuously increases from a start point to an end point of the outer radius increasing portion, and in the diffuser section outer radius distribution, a position of the start point of the outer radius increasing portion is 150° or less, and a position of the end point of the outer radius increasing portion is 270° or more.

2. The centrifugal compressor according to claim 1, wherein, in the diffuser section outer radius distribution, A2-A1≥150° is satisfied, where A1 is the position of the start point of the outer radius increasing portion, and A2 is the position of the end point of the outer radius increasing portion.

3. The centrifugal compressor according to claim 2, wherein A2-A1≥180° is satisfied.

4. The centrifugal compressor according to claim 1, wherein the outer radius increasing portion includes a nonlinear increasing portion where the outer radius R nonlinearly increases going toward the positive direction.

5. The centrifugal compressor according to claim 4, wherein a portion of the nonlinear increasing portion belonging to a range from 210° position to 360° position in the circumferential direction includes a convex curved portion that is convex upward.

6. The centrifugal compressor according to claim 4, wherein a portion of the nonlinear increasing portion belonging to a range from 60° position to 210° position in the circumferential direction includes a convex curved portion that is convex downward.

7. The centrifugal compressor according to claim 1, wherein, in a cross-section perpendicular to a rotational axis of the impeller, a portion of an outer peripheral edge of the diffuser section connecting a position where the outer radius R is maximum and a position where the outer radius R is minimum is formed by a part of an ellipse.

8. The centrifugal compressor according to claim 7, wherein a center of the ellipse is eccentric with respect to the rotational axis of the impeller.

9. A turbocharger comprising the centrifugal compressor according to claim 1.

* * * * *